United States Patent [19]

Wesley

[11] 4,162,182

[45] Jul. 24, 1979

[54] LABELING MACHINE FOR APPLYING LABELS TO POLYGONAL CONTAINERS

[75] Inventor: John G. Wesley, Berwyn, Ill.

[73] Assignee: Labelette Company, Forest Park, Ill.

[21] Appl. No.: 835,442

[22] Filed: Sep. 21, 1977

Related U.S. Application Data

[63] Continuation of Ser. No. 682,641, May 3, 1976, abandoned.

[51] Int. Cl.[2] ..... B65C 3/12

[52] U.S. Cl. ..... 156/487; 156/212

[58] Field of Search ..... 156/443, 446, 486–487, 156/492

[56] References Cited

U.S. PATENT DOCUMENTS

| | | | |
|---|---|---|---|
| 1,134,876 | 7/1915 | Larsen | 156/487 X |
| 3,001,660 | 9/1961 | Carter | 156/487 X |
| 3,206,912 | 9/1965 | Neubronner | 156/487 X |
| 3,625,797 | 2/1971 | Wesley | 156/446 |

*Primary Examiner*—David A. Simmons

[57] ABSTRACT

An improvement in labeling machines of the type shown in U.S. Pat. No. 3,625,797, in which provision for applying labels about polygonal shaped containers is made by providing a pair of spaced holders that are mounted for rotation about a horizontal axis and mount the container to be labeled between them for rotation thereby. The labels are fed one by one from a hopper to a labeling position at one side of the rotating container where a brush member, having a brush type flap projecting therefrom, is mounted for consecutive wiping engagement with all sides of the container as they are presented thereto when the container is rotated. When a container is mounted between the holders to be labeled, and the label to be applied thereto is fed between the brush member and the container, the brush member is moved toward the container to forcefully brush the leading end of the label into firm adherence with the container. The brush member is shifted back to its initial position for wiping the label against the container sidewalls and corners, whereby the rest of the label is cammed against the container sides consecutively presented to the brush member.

2 Claims, 14 Drawing Figures

LABELING MACHINE FOR APPLYING LABELS TO POLYGONAL CONTAINERS

This application is a continuation of my application Ser. No. 682,641, filed May 3, 1976, now abandoned.

This invention relates to the semi-automatic application of labels to containers of quadrilateral or other than round transverse cross-sectional configuration, and more particularly, to the provision of labeling machines that provide application of a label about the sides of square or rectangular containers.

The labeling machine of my U.S. Pat. No. 3,278,359 provides an arrangement for conveniently applying labels to round containers in which the containers are one by one laid sidewise on a pair of rotating support rollers, and the labels for same are separated from a supply of labels in a hopper, fed past a glue station where glue is applied thereto, and guided into cooperation with the container in timed relation to the rotation of the container, so that the label becomes affixed to the round side wall of the container in the manner desired. In accordance with the invention of that patent, the labeling machine is arranged to both handle labels to different lengths and to either coat the entire length of the label or coat only selected spaced portions of same, such as the leading and trailing ends of the label.

Utilization of rotational movement of round containers (about their longitudinal axes) as part of the label applying procedure is not directly applicable to polygonal containers of the familiar rectangular or square transverse cross-sectional configuraion shapes, as placing such containers on rotating actuating roller will not effect the uniform rotational movement of the container that is required for proper sequencing purposes.

My U.S. Pat. No. 3,625,797 provides an attachment for application to the machine of my earlier U.S. Pat. No. 3,279,359 that involves a swing lever assembly which may be pivotally mounted on the round container labeling machine adjacent its support rollers and carries a pair of opposed spin wheel assemblies that mount the container to be labeled, and that are brought by gravity into tractional engagement with such support rollers for rotation of the container carried thereby. The swing lever assembly includes a pressure roller arrangement for holding the label against the container it is being applied to, and the spin wheel assemblies are coupled together through gearing for synchronous rotation. Application of the spin wheel assemblies to the machine support rollers, which continuously rotate, actuates a switch control arrangement that sets up the machine for its label gluing and applying cycle, and starts rotation of the container through the tractional engagement that the spin wheel assemblies have with the support rollers; such rotation brings the container into engagement with a trip switch that in turn effects actuation of the label gluing and applying mechanism in the timed sequence required to properly apply the label to the container. After the label is applied to the container, the swing lever assembly is actuated to lift the spin wheel assemblies from the support rollers for removal of the now labeled container, and application thereto of another container to be labeled.

A principal object of this invention is to provide a labeling machine arrangement that will label polygonal containers with the same facility that round containers may labeled.

Another principal object of the invention is to provide labeling machines of the general type disclosed in my said U.S. Pat. No. 3,278,359 that will handle polygonal containers of variant sizes and with equal facility.

Other objects of the invention are to provide a machine and method for semi-automatically applying a label about the sides of containers of square or rectangular transverse section with the same facility that the machine of my said U.S. Pat. No. 3,278,359 has for labeling round containers, and to provide a labeling machine that is economical of manufacture, convenient to use, and long lived in operation.

In accordance with the present invention, a labeling machine of the general type disclosed in my said U.S. Pat. No. 3,278,359 at the labeling station is provided with a pair of spaced apart container holders that are mounted for rotation about a horizontal axis and receive between same the container to be labeled for rotation thereby. The labels are fed one by one from a hopper to the machine labeling position at one side of the rotating container where a brush or flap member, having one or more brush type flaps projecting therefrom, is mounted for consecutive wiping engagement with the container sides and corners as the container is rotated for application of the label thereto. The brush member is also mounted for controlled movement toward and away from the container to vary its bias thereagainst. When the container is mounted in the holders to be labeled, the holders are synchronously rotated to rotate the container; the label to be applied to the container is fed between the brush member and the container, with the member at this point being shifted against the label leading end, whereby the brush member firmly brushes the leading end of the label into firm adherence with the container. As rotation of the container continues, the brush member is automatically returned to its initial container wiping position, and while rotation of the container continues, the brush maintains a brushing or wiping pressure on the label, whereby the rest of the label is cammed against the container sides as consecutively presented to the brush member.

Still other objects, uses, and advantages will be obvious or become apparent from a consideration of the following detailed description and the application drawings in which like parts are indicated by like reference numerals throughout the several views.

In the drawings:

FIG. 1 is a diagrammatic perspective view of several of the basic components of the labeling machine of the present invention as associated with the arrangement of my said U.S. Pat. No. 3,278,359, with the label hopper of the machine being shown only in outline form;

GENERAL DESCRIPTION

Figure 6:
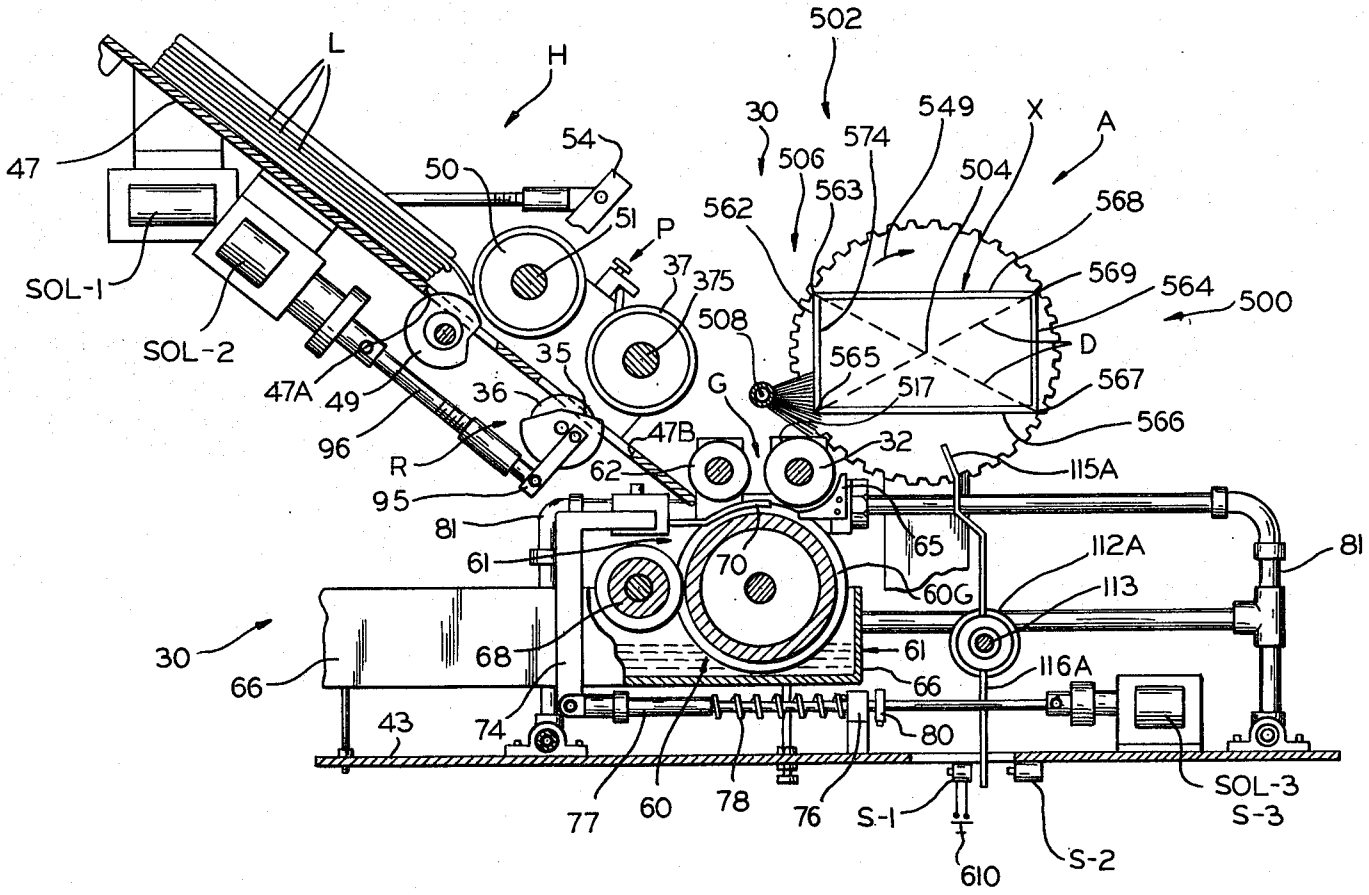
FIG. 6 is a diagrammatic cross-sectional view taken substantially along line 6—6 of FIG. 1 illustrating the specifics of the labeling machine arranged in accordance with the present invention.

Referring initially to FIG. 6, which shows a number of the basic components on the machine of my said U.S. Pat. No. 3,278,359 as associated with the present invention, it will be seen that the machine or apparatus 30 generally comprises an inclined adjustable hopper H in which a supply of labels L are supported for separation and feeding one by one past a glue station G, and after glue has been applied to the individual labels, such labels are guided into cooperation with a rotating container X (to be labeled) that is disposed at label applying station A. In the arrangement of said U.S. Pat. No. 3,278,359, round containers to be labeled are applied to a pair of constantly driven support rollers that form the label applying station, with one of the rollers being located on a fixed axis adjacent to and above the output side of the glue station G (and in practice corresponding to roller 32 of FIG. 4), while the other support roller (not shown as unnecessary for the present invention) is mounted to the right of roller 32 for adjustment toward and away from the roller 32 so that containers of different diameters may be supported and rotated in the desired relation by the two rollers supporting same.

As described in said patent, the labels L are fed one at a time from the hopper H to a register station R that is defined in part by a retractable register stop 35, and when the leading edge of a label L is engaged with the stop 35, such leading edge is located between a pair of constantly driven normally separated feed rollers 36 and 37, so that upon withdrawal of the stop 35, and on engagement with the label in question of the two feed rollers 35 and 36, the label L in question is withdrawn from the register station R and is advanced to and through the glue applying station J for application to the container.

In accordance with the present invention, the machine 30 is provided with container holder device 500 with which is operably associated a shifting brush device 502. The device 500 rotatably mounts the container X, while the device 502 cooperates with the container as it is rotated, and the label that is being applied to same, in the manner indicated in diagrammatic FIGS. 7–14 to effect application of the individual labels to a container X in accordance with the invention.

The container mounting device 500 is mounted on the machine 30 at the labeling station A to rotatably mount the container X about a horizontal axis 504, while the brush device 502 comprises a flap or brush member 506 disposed, in the present instance, above the gluing station G, and for pivotal movement about horizontal axis 508 that parallels the axis 504 and that is positioned to dispose the brush member 506 in wiping engagement with the sides of the container X, as the sides of the container X are presented to the wiper member on rotation of the latter.

Figure 1:
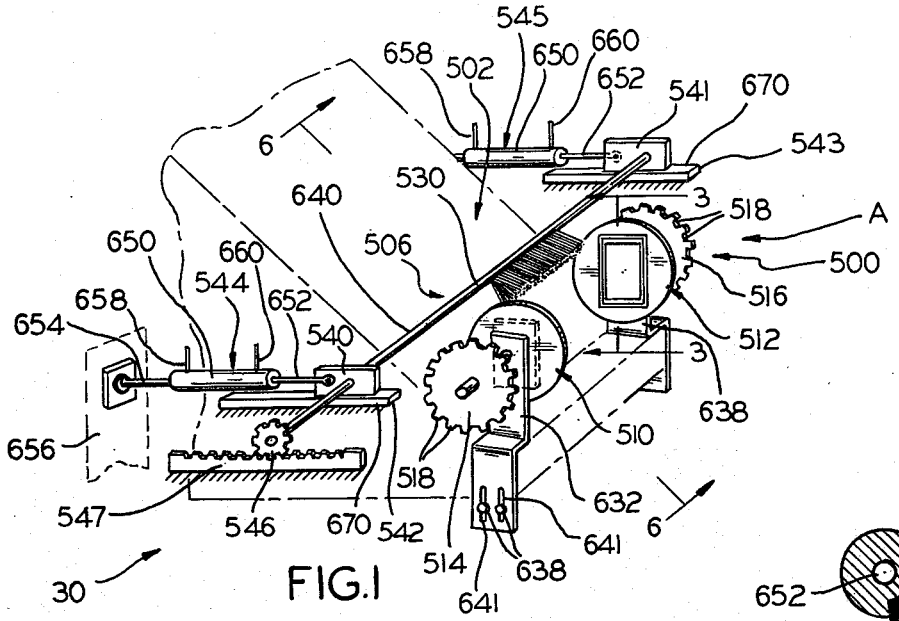

The mounting device 500 comprises a pair of spaced mounting or holder members 510 and 512 (see FIG. 1) each journaled for rotation about the axis 504. The holder member 510 has a gear 514 keyed with respect thereto while the holder member 512 has a gear 516 keyed with respect thereto. The gears 514 and 516, in accordance with the invention, are proportioned such that their gear teeth 518 have a pitch diameter that is equivalent to the length of the diagonal dimension D of the transverse cross-sectional configuration of a container X (see FIG. 6). Also, the holder members 510 and 512 are disposed relative to label feed roller 32 (see FIG. 6) such that when the container diagonals D are disposed radially of roller 32, their ends will be in the range of from approximately ⅛th inch to approximately 1/16th inch from the periphery 517 of roller 32. This insures proper timing of the linear speed of the container with the linear speed of the individual labels during their application to the container, as represented by the movement rate of periphery 517 of roller 32 (which roller 32 may be termed the label applying roller).

The gears 514 and 516 respectively mesh with identical drive gears 520 and 522 that are suitably synchronously driven by suitable drive means to synchronously rotate the gears 514 and 516, and thus the respective holder members 510 and 512, about axis 504.

Figure 5:
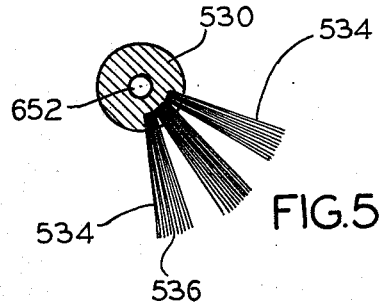
FIG. 5 is a view similar to that of FIG. 4 illustrating a modified form of flapper member.
Figure 4:
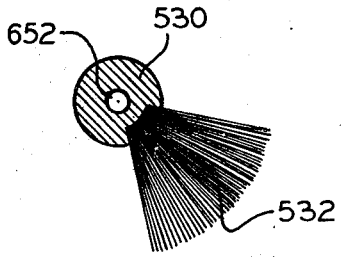
FIG. 4 is a transverse cross-sectional view through the flapper member forming a key part of the present invention.

The brush member 506 comprises a core member 530 provided with one or more brush type flaps 532 that in the form shown in FIG. 4 comprises brush bristles 536 suitably fixed to core member 530 and sufficient in quantity to shape a single flap 532 to extend approximately 60–90 degrees of the circumference of core member 530. The bristles may be arranged in closely spaced rows or bundles, as is convenient in forming flap 532, to have the tightly bunched brush bristle arrangement that is indicated for flap 532. Alternately, the flap 532 may be formed by separate rows 534 of brush bristles 536, as indicated in the form of FIG. 5, to form closely spaced relatively thin flaps 532A. The flaps 532 and 532A should extend, in any event, lengthwise of the flapper member 506 sufficiently to overlap the width of the individual labels L to be handld by the machine 30.

Brush member 506 is mounted for shifting movement toward and away from the axis 504 by being journaled in bearing members 540 and 541 reciprocably mounted in the respective tracks 542 and 543. The bearing members 540 and 541 are held stationary during most of the invention label application cycle to maintain the brush member axis 508 disposed so that the brush member bristles will be in wiping engagement with all the container sides as the container is rotated. This is done in the form shown by utilizing the respective air cylinder devices 544 and 545 that are also operated to shift the brush member against the container as the leading end of the label (to be applied to that container) enters between the container and the brush member 506 (see FIG. 10), and as the container and label approach the positions of FIG. 11 (from the position of FIG. 10), to shift the brush member 506 back to the position of FIG. 7. Devices 544 and 545 are operated in any suitable manner utilizing suitable sensing and sequencing controls to maintain and provide the brush member axis relationship relative to the container sides that has been indicated. Further in accordance with the invention, brush member 506 is pivoted as it is shifted laterally of the container by having its core member 530 keyed to gear 546 meshing with fixed rack 547.

The operating components of the machine may be electrically or otherwise operated by suitable push button controls provided on the machine 30 at a position handy to the operator in any manner consistent with the objects of the invention. The operator of the machine stands at an operating position to the right hand side of FIG. 6 to apply and remove containers from the holder device 500 as the labeling proceeds, and to control the operation of the holder device 500 and the brush device 502.

Figure 3:
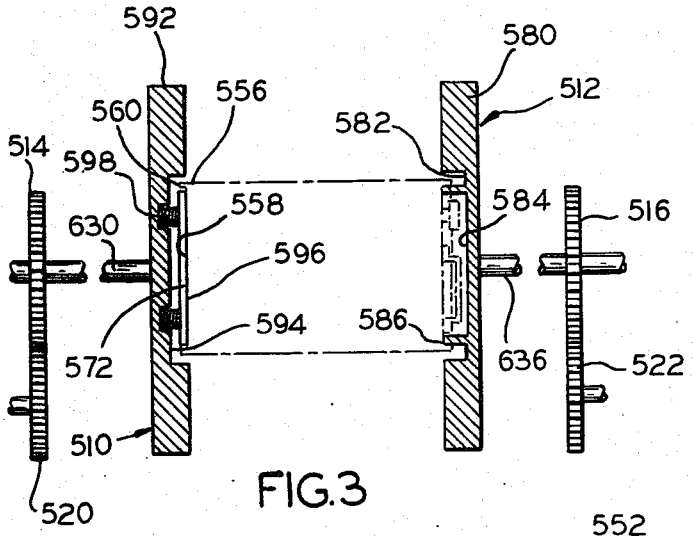
FIG. 3 is a diagrammatic cross-sectional view through the container holders of the present invention, diagrammatically illustrating the nature of same, and taken substantially along line 3—3 of FIG. 1.
Figure 2:
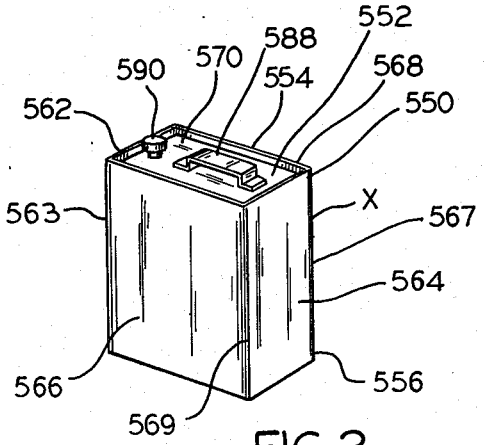
FIG. 2 is a perspective view of one form of familiar container that may be labeled by practicing the invention of this application.

FIG. 2 illustrates one familiar form of container X of the type adapted to be labeled by the practice of the invention in which the container has an upper end portion 550 recessed as at 552, the container defining an upper ridge portion 554 thereabout. The lower end 556 is similarly formed as indicated at 558 and 560. The container X defines narrow side walls 562 and 564, wide side walls 566 and 568, top end wall 570, bottom end wall 572 (see FIG. 3), and longitudinally extending corners 563, 565, 567 and 569. The container X is usually seamed down the midportion of its narrow side 562. While the label to be applied to a container X may be started at any desired point about its periphery, I prefer that the label start and end at the can seam, which seam is indicated at 574 in FIGS. 6–14.

In the form shown, the holder members 510 and 512 are arranged to mount between them the container X by the holder member 512, for instance, being in the form of disc 580 recessed at 582 and 584 to define a rectangular ridge portion 586 that is adapted to be received within and substantially complement the configuration of the ridge portion 554 of the container upper end 550. The recess 584 is made sufficiently deep to accommodate the container handle 588 and opening cover 590.

The holder member 510 comprises disc 592 formed with recess 594 proportioned to receive the lower end 556 of the container X as well as a spring plate 596 that is outwardly biased by suitable compression springs 598 and is proportioned to fit within recessed portion 558 of the container X. The spring plate 596 and disc 592 may be provided with suitable laterally engaging portions to preclude removal of the spring plate 596 on removal of the container X, as will be apparent to those skilled in the art. The recess 594 is proportioned to substantially complement the external configuration of the container lower end 556, while the recess 582 is proportioned to substantially complement the external configuration of the container upper end 550.

Referring back to the general arrangement of the machine 30, machine 30 is provided with control switch S-1 that corresponds to the switch S-1 of my said U.S. Pat. No. 3,278,359 except for purposes of this disclosure it is shown to be hand actuated by the machine operator employing suitable actuator 610 suitably spring loaded to open switch S-1 when released. Actuation of the normally open switch S-1 sets up the machine 30 for but does not actuate, a label gluing and applying cycle with respect to a label L that has been moved into the register position. Rotation of the holder device 500 with a container X applied thereto has the effect of the container X tripping a sensing arm 115A fixed on a sleeve 112A that is rotatable on shaft 113 that has an operating arm 116A extending downwardly therefrom to engage and actuate a normally open control switch S-2, which switch actuation initiates the operation of the sequencing of the parts of the machine 30 which advance the label L through the gluing station G and into application with the container following the sequence suggested by FIGS. 7–14, and in the timing desired relative to the speed of rotation of the container X.

My said U.S. Pat. No. 3,278,359 (the disclosure of which is incorporated herein by this reference) may be referred to for a detailed description of the component parts and operation of the machine therein disclosed, some of the parts thereof being shown in the drawings of the instant application, indicated by identical reference numerals, to facilitate a more ready understanding of the nature of the present invention.

In use, assuming that labels L of a size suitable for application to the particular container X to be labeled, have been applied to hopper H, and the machine 30 is otherwise set up as described in my said U.S. Pat. No. 3,278,359, prior to actuation of the holder device 500, the container X to be labeled is applied to the holder device 500 in the manner indicated in FIG. 3, with the container lower end 556 being pressed against the spring plate 596 so that the lower end 556 is disposed within the recess 594 of holder member 510, and the ridge portion 586 of holder member 512 is received within the recessed portion 552 of the container end 550.

The container X should also be disposed so that its seam side 562 faces away from the operator, who will be standing at the right of FIG. 6, with the holder device being disposed so that its wide sides 566 and 568 are substantially horizontally disposed, and the container X and the flapper member 506 have the approximate relationship indicated in FIG. 6.

Figure 7:
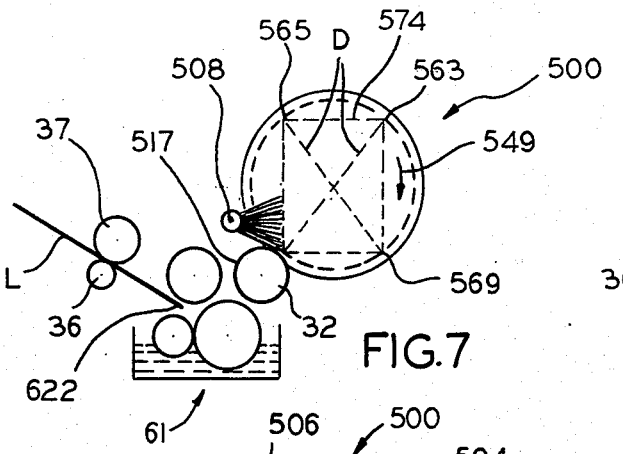
FIGS. 7–14 are diagrammatic sequence views illustrating the manner in which a label is applied to a polygonal container in accordance with the present invention.

By suitably operating the machine controls, the holder device 500 is rotated to rotate the container X in the direction indicated by the arrow 549 of FIG. 7. As previously indicated, the brush or flap member 506 is normally positioned so that is bristles will normally be in constant contact with the container as the latter rotates even though the spacing of the container sides and corners from the brush axis 508 varies between maximum and minimum as the container rotates (compare FIGS. 7–14).

Rotation of the holder device 500 from the initial position of FIG. 6 will bring the container corner 567 into engagement with the detecting arm 115A, and assuming that the switch S-1 has been closed, the solenoid SOL-2 is actuated (by arm 116A closing normally open switch S-2) to withdraw the register stop 35 and bring rollers 36 and 37 into engagement with the label to be applied to the container X, to effect feeding of the label to be applied to the rotating container in coordination with the movement of the can seam 574 as indicated in FIG. 7. The holder device 500 continues to turn the container X through the positions of FIGS. 8 and 9, and to the position of FIG. 10, at which point the leading end 622 of the label is to engage with the seam side 562 of the container. As the container X continues to rotate in the direction of the arrow 549, the brush member 506 at this point is shifted laterally of axis 504 to bear firmly against the leading label end 622 to effect firm adherence of the label leading end to the container.

As the container seam side 562 swings upwardly the second time through the level of axes 504 and 508, brush member 506 is returned to the position of FIG. 7, relative to axis 504, with the brush member continuing its wiping action on the label being applied to the container.

It is also to be noted that the brush in being shifted laterally also pivots about its axis 508, due to its geared coupling to stationary rack 547. When the brush member 506 is moved toward axis 504, it pivots in the direction indicated by arrow 548 of FIG. 10, and when being shifted away from axis 504, it pivots in the opposite direction. Thus, when the container is in its positions of FIGS. 7–9 and 11–14, the brush member 506 is at a stationary or dwell position (both pivotally and as to movement laterally of axis 504).

Figure 10:
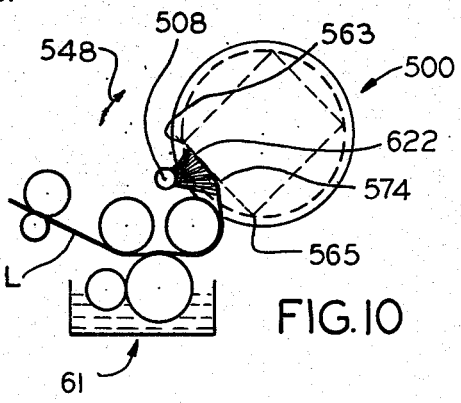
Figure 14:
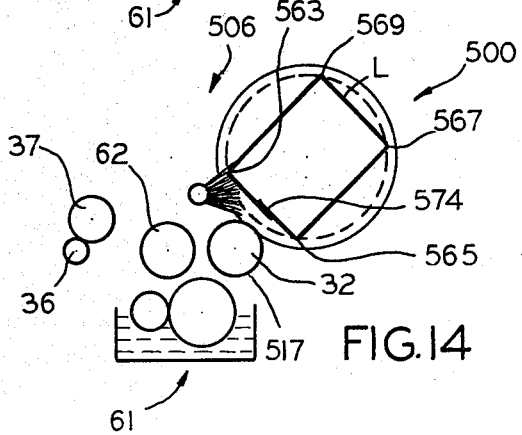

This pivotal action of brush member 506 as the container and label move to and past the positions of FIG. 10 first effects a clockwise (as viewed in FIGS. 7–14) wiping action of the brush bristles on the label leading end as the brush member is moved toward the axis 504, and then a counterclockwise wiping action of the same character as the brush member is moved back to the position of FIG. 7, whereby a particularly effective reversing or back and forth wiping action is practiced on the label leading end for insuring firm adherence of same to the container. For this purpose, machine 30 has suitable cycling controls (that may be of the programmable type) built into same for controlling the operation of air cylinder devices 544 and 545 as needed to achieve this end.

Figure 11:
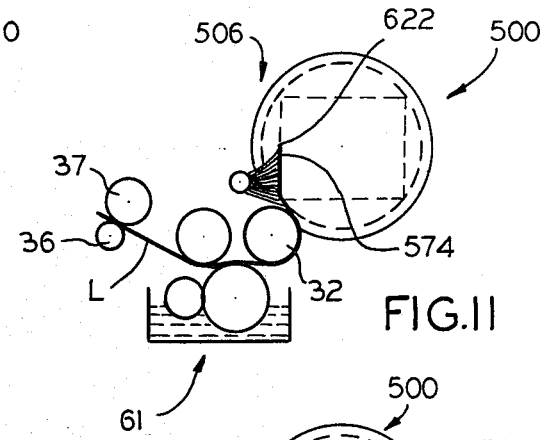
Figure 8:
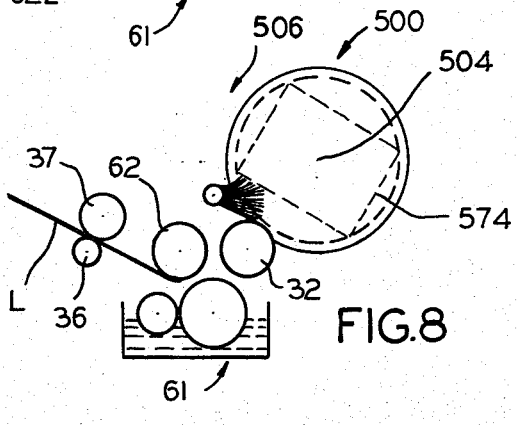
Figure 12:
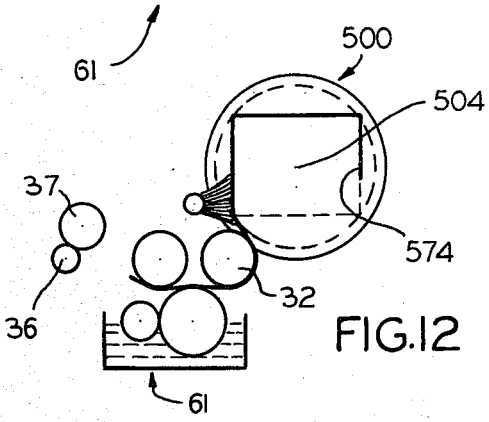
Figure 9:
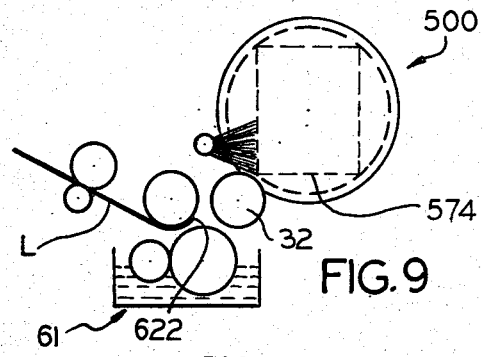
Figure 13:
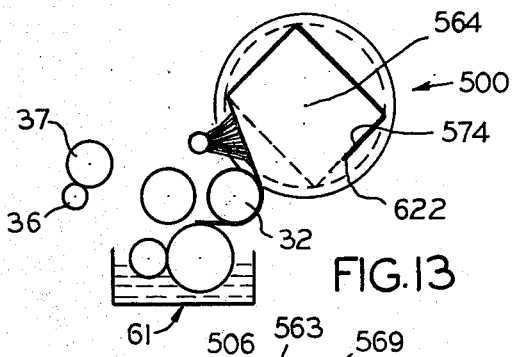

The holder device 500 continues to turn through the positions of FIGS. 11–13, with the bristles of the now stationary brush member 506 continuing to wipe the label against the container sides and corners. The label L is thus being drawn between the container and the brush member, and cammed against the respective container sides, by the biasing action that the brush member bristles apply to the label, thereby insuring firm contact of the label along its length against the underlying side surfaces of the container. As the holder device 500 moves the container X to complete 360 degrees of movement (that is, through the position of FIG. 14 to the position of FIG. 6), the brush member 506 continues and completes this wiping action. While ordinarily not necessary, the brush member 506 at this point may again be shifted toward axis 504 to repeat the indicated reverse wiping action on the label trailing end. Adherence of the label to the container sides is now complete.

Rotation of the holder device 500 is then stopped to remove the newly labeled container X and replace same with another container X to be labeled in the same manner. Closing of switch S-1 by the operator effects movement of the next label to the register stop position in the manner described in my said U.S. Pat. No. 3,278,359.

SPECIFIC DESCRIPTION

The machine 30 as disclosed in my said U.S. Pat. No. 3,278,359 has a pair of side frame members (not shown) that are located in spaced relation, and at the rear portions these frame members have upstanding support plates that serve as a mounting means for the hopper H and for other elements of the machine. The hopper H is provided with a sloping bottom plate 47 that slopes downwardly and has a pair of adjuatable side guides (not shown) to provide a hopper in which a stack of the labels L are positioned.

At the forward end of the hopper H, a label separating means is provided of the top feed type, and has an adjustable but normally stationary rubber retard roller 49 mounted on an adjustable axis at an opening 47A formed in plate 47. Above the retard roller 49 and on an axis parallel thereto are one or more separating rollers 50 that are fixed on a freely adjustable supporting shaft 51 (which is supported and driven in the manner shown and described in said U.S. Pat. No. 3,278,359), which includes suitable gearing actuated by a swing arm 54 being moved to shift a rubber roll into engagement with a constantly driven knurlled roll (see FIG. 5 of U.S. Pat. No. 3,278,359) fixed to the shaft 37S which carries feed rolls 37 (this being done by operation of solenoid SOL-1).

A photoelectric unit P is employed to detect when a label L being advanced has reached the register position. The unit P is fully disclosed in said U.S. Pat. No. 3,278,359.

As indicated in FIG. 6, the feed rollers 36 and register stop 35 project through an opening 47B in the plate 47, and the hopper plate 47 extends beyond or to the right of the opposed feed rollers 36 and 37 to a point just above the left hand side of the relatively large coating roller 60 that forms a part of glue coater 61 that is located just beneath and somewhat to the left of the roller 32 (as shown in FIG. 6). Thus, as a label L is advanced by the feed rollers 36 and 37 from a register position, such label L moves along the plate 47 and beneath the guiding feed roller 62 and thence into engagement with the constantly rotating coating roller 60 and stationary control fingers 70 (disposed in the coating roller grooves 60G) from which it moves into label applying position beneath the roller 32, where the leading edge 622 of the label strikes a series of spaced guide plates 65 that direct the leading edge of the label outwardly from between the guide plates 65 and the roller 32 into a position where the label will engage the container X in the manner suggested by FIG. 10.

Other related parts of the machine of my said U.S. Pat. No. 3,278,359 are shown in FIG. 6 with identical reference numerals being applied thereto, it being understood that reference may be had to my said U.S. Pat. No. 3,278,359 for a complete description of the component parts involved.

In the diagrammatically illustrated embodiment that is shown in the drawings, the disc 592 forming the holder member 510 is fixed to shaft 630 that is suitably journaled in mounting bracket 632 suitably affixed to the frame of machine 30. Gear 514 in turn is slightly keyed to shaft 630. Similarly, the disc member 580 forming holder member 512 is suitably fixed to shaft 636 in turn suitably journaled in mounting bracket 638, in coaxial relation with shaft 630 and axis 504, with the gear 516 being suitably keyed to shaft 636. Mounting bracket 638 is also suitably secured to the frame of machine 30. Brackets 632 and 638 are adjustably mounted in position, as by employing bolts 639 in their mounting slots 641, so that the mounting device 500 can be properly positioned relative to roller 32, that is, so that the container diagonals D will have the indicated closely spaced relation to the periphery of roller 32. This permits proper coordination of the rotation of the container with the movement of the individual labels through the machine 30 and onto the individual containers.

The brush member 506 comprises, in the form shown, shaft 640 suitably journaled in the bearings 540 and 541 (which are shown in block diagram form, as they can be of any suitable type). the shaft 640 receives and has keyed thereto the core element 530, which in the forms shown is of cylindrical configuration, and is formed with radial slotting having suitably secured therein the brush bristles 536 (that form the flaps 532 or 534), as by being glued or otherwise bonded in place. The core member 530 is bored as at 652 to receive the shaft 640. It is preferred that the flaps 532 or 534 project from their cores about two inches.

As indicated, the holder members 510 and 512 and their driving gears 514 and 516 are sized relative to the containers X they are to mount such that the pitch diameter of the gear teeth of the gears 514 and 516 is equivalent to a distance between diagonally opposed corners of the container to be labeled, represented by he dimension D of FIG. 6. It is therefore desirable that a holder device 500 be provided for each size container X to be labeled, with the bracket members 632 and 638 for same being adapted for adjustable mounting on the frame of machine 30 to provide the operating relationships with the brush member 506 that have been described.

Air cylinder devices 544 and 545 are shown largely in block diagram form, as their specifics are largely optional. As shown they each comprise a cylinder 650 having a piston (not shown) reciprocably mounted therein with its piston rod 652 suitably connected to the respective bearing 540 and 541. The respective cylinders 650 each have fixed thereto a mounting rod 654 suitably connected to the frame stationary framing 656. Fluid under pressure is supplied to the respective cylinders through suitable conduits 658 and 660 and leading to a suitable source of fluid under pressure suitably controlled to provide the cycling movement of brush member 506 that has been indicated. Of course, air cylinder devices 544 and 545 may be disposed 180 degrees from their positions of FIG. 1, as desired, with their controls changed accordingly to give the brush member shifting movement indicated.

Gears 520 and 522 are mounted in machine 30 and driven in any suitable manner. Tracks 542 may conveniently be channel members 670 suitably fixed to the machine 30 in a horizontal plane paralleling those in which axes 504 and 508 lie. An approximate two inch path of movement of the bearing members 540 and 541 is preferred.

It will therefore be seen that the invention provides a simplified yet effective manner of applying labels to polygonal containers utilizing the basic features of the machine shown in my said U.S. Pat. No. 3,728,359 as modified as disclosed herein. This invention permits polygonal containers of the type preferred to to be labeled as readily as round containers and with the same adjustability as to container and label size as contemplated for round containers by my said U.S. Pat. No. 3,278,359.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In a labeling machine for applying labels to containers of quadrilateral transverse cross-sectional configuration and defining external side walls forming external corners extending longitudinally thereof along the sides of the container, said machine including a label supply hopper, a glue applying station, and a labeling station including means for supporting and rotating the container to be labeled about a horizontal axis at the labeling station with the container longitudinal axis coincident with said horizontal axis, and means for feeding labels longitudinally thereof along a predetermined feed path from the hopper through the glue applying station to a label applying relation position with the container at the labeling station, the improvement wherein:

said means for supporting and rotating the container comprises:

a pair of spaced apart holder members journalled for rotation about said axes, means for holding said holder members against movement laterally of said axes, said holder members including means for mounting one of the containers therebetween by engaging the ends thereof for rotating same about said axes, means for synchronously rotating said holder members about said axes to rotate the container held thereby about said axes whereby the container corners rotate in a circular path that is concentric with said axes, said glue applying station including means for applying glue to the underside of the label when received from said label supply station, and said feeding means including a rotatable label feed roller paralleling said axes and journalled relative thereto to dispose the periphery of said feed roller in close adjacency to but spaced from said container corner circular path, said feed roller also being disposed below the level of said axes and in overlying relation to said feed path, a label feed guide mounted below said feed roller and including guide surfacing concentric with said feed roller periphery and disposed to direct the leading end of a label to be applied to the container to the label applying position, means for rotating said feed roller oppositely of the direction of rotation of said holder members at a speed whereby said feed roller periphery has a surface speed approximating the speed of the container corners along said circular path, and including a label wiping device mounted between said container supporting means and the hopper above and adjacent to said feed roller and comprising:

a brush member mounted to parallel said axes and including a projecting brush flap, said flap being proportioned and positioned for wiping engagement with the side walls of the container mounted by said holder members, adjacent the label applying position, when the container is supported by said supporting means, means for maintaining said brush member flap in biased relation against the container side walls when said holder members are rotated, said rotating means rotating said holder members in the direction that moves the container corners consecutively past said feed roller and said brush member in that order, whereby, when a container to be labeled is rotated by said holder members and a label to be applied to the container is moved to said label applying relation position, the label is wiped on the container about said side walls and corners thereof by the wiping engagement of the brush member flap with the container, and means for oscillating said brush member sidewise of said flap during rotation of said holder members, while said flap is maintained in engagement with the container, when the leading end of the label is being applied to the container engages the container, whereby the label leading end is subjected to an oscillating brushing action of said flap thereagainst and against the container.

2. In a labeling machine for applying label to containers of quadrilateral transverse cross-sectional configuration and defining external side walls forming external corners extending longitudinally thereof along the sides of the container, said machine including a label supply hopper, a glue applying station, and a labeling station including means for supporting and rotating the container to be labeled about a horizontal axis at the labeling station with the container longitudinal axis coincident with said horizontal axis, and means for feeding labels longitudinally thereof along a predetermined feed path from the hopper through the glue applying station to a label applying relation position with the container at the labeling station, the improvement wherein:

said means for supporting and rotating the container comprises:

a pair of spaced apart holder members journalled for rotation about said axes, means for holding said holder members against movement laterally of said axes, said holder means including means for mounting one of the containers therebetween by engaging the ends thereof for rotating same about said axes, means for synchronously rotating said holder members about said axes to rotate the container held thereby about said axes whereby the container corners rotate in a circular path that is concentric with said axes, said glue applying station including means for applying glue to the underside of the label when received from said label supply station, and said feeding means including a rotatable label feed roller paralleling said axes and journalled relative thereto to dispose the periphery of said feed roller in close adjacency to but spaced from said container corner circular path, said feed roller also being disposed below the level of said axes and in overlying relation to said feed path, a label feed guie mounted below said feed roller and including guide surfacing concentric with said feed roller periphery and disposed to direct the leading end of a label to be applied to the container to the label applying position, means for rotating said feed roller oppositely of the direction of rotation of said holder members at a speed whereby said feed roller periphery has a surface speed approximately the speed of the container corners along said circular path, and including a label wiping device mounted between said container supporting means and the hopper above and adjacent to said feed roller and comprising:

a brush member mounted to parallel said axes and including a projecting brush flap, said flap being proportioned and positioned for wiping engagement with the side walls of the container mounted by said holder members, adjacent the label applying position, when the container is supported by said supporting means, means for maintaining said brush member flap is biased relation against the container side walls when said holder members are rotated, said rotating means rotating said holder members in the direction that moves the container corners consecutively past said feed roller and said brush member in that order, whereby, when a container to be labeled is rotated by said holder members and a label to be applied to the container is moved to said label applying relation position, the label is wiped on the container about said side walls and corners thereby by the wiping engagement of the brush member flap with the container, said brush member being mounted for movement laterally of said axes, and said maintaining means comprising fluid cylinder means for effecting said brush member biased relation, said brush member being mounted for oscillating movement about its longitudinal axis, and means for effecting limited back and forth oscillating movement of said brush member on movement of said brush member laterally of said axes whereby the label leading end is subjected to an oscillating brushing action of said flap thereagainst and against the container.

* * * * *